US008608623B2

(12) United States Patent
Lee

(10) Patent No.: US 8,608,623 B2
(45) Date of Patent: Dec. 17, 2013

(54) LEG REHABILITATION SYSTEM HAVING GAME FUNCTION

(75) Inventor: Yang-Soo Lee, Daegu (KR)

(73) Assignee: Industry-Academic Corporation Foundation, Kyungpook National University, Daegu (KR)

( * ) Notice: Subject to any disclaimer, the term of this patent is extended or adjusted under 35 U.S.C. 154(b) by 436 days.

(21) Appl. No.: 13/081,486

(22) Filed: Apr. 6, 2011

(65) Prior Publication Data

US 2011/0251022 A1 Oct. 13, 2011

(30) Foreign Application Priority Data

Apr. 7, 2010 (KR) ..... 10-2010-0031705

(51) Int. Cl.
*A63B 24/00* (2006.01)

(52) U.S. Cl.
USPC ..... 482/8; 482/1; 482/52; 482/901

(58) Field of Classification Search
USPC ..... 482/1–9, 51–53, 901; 434/247
See application file for complete search history.

(56) References Cited

U.S. PATENT DOCUMENTS 5,001,632 A * 3/1991 Hall-Tipping ..... 463/7
2005/0075213 A1* 4/2005 Arick ..... 482/1
2008/0102424 A1* 5/2008 Holljes ..... 434/247

FOREIGN PATENT DOCUMENTS

KR 10-2005-0092546 A 9/2005

OTHER PUBLICATIONS

Nugent, et al., A Dose-Response Relationship Between Amount of Weight-Bearing Exercise and Walking Outcome Following Cerebrovascular Accident, pp. 399-402, 1994, The American Congress of Rehabilitation Medicine and the American Academy of Physical Medicine and Rehabilitation.

* cited by examiner

*Primary Examiner* — Glenn Richman
(74) *Attorney, Agent, or Firm* — Husch Blackwell LLP

(57) ABSTRACT

The present invention relates to a leg rehabilitation system having a game function. The rehabilitation system comprises: a back plate for supporting a back of a patient; a stepper part having two foothold parts, the back plate being extended from a bottom portion of the back plate in such a manner that a patient can move the two foothold parts downwardly in turn with legs of the patient, a load sensor positioned on the stepper part for sensing a load transferred to each foothold part and the movement speed of the foothold part when the patient moves the legs; a controller configured for generating game data based on load data according to the load sensed by the load sensor and speed data according to the movement speed; and a display unit for displaying graphical game elements corresponding to the game data generated by the controller.

25 Claims, 5 Drawing Sheets

LEG REHABILITATION SYSTEM HAVING GAME FUNCTION

CROSS-REFERENCE TO RELATED APPLICATIONS

This application claims priority to and the benefit of Korean Patent Application No. 10-2010-0031705 filed in the Korean Intellectual Property Office on Apr. 7, 2010, the entire contents of which are incorporated herein by reference.

TECHNICAL FIELD

The present invention relates to a leg rehabilitation system having a game function. More particularly, the present invention relates to a leg rehabilitation system having a game function, which is an apparatus for rehabilitation therapy of patients with paraplegia, muscle weakness, or cardiopulmonary weakness, capable of training both legs separately, measuring a change in an angle of a leg joint and a magnitude of a load applied to the footplate to measure an exercise state, momentum, torque, power, work and athletic ability of each leg while training the legs and feeding back the measured excursion state, momentum, torque, power, work and athletic ability, and allowing a patient to take a muscular exercise and arousing an interest while viewing graphics displayed on a display unit in real time by utilizing game data generated according to a motion of the alternate movements of the patient's legs.

BACKGROUND

Generally, a hemiplegia may occur due to stroke, traumatic brain injury, or cerebral palsy, etc., and the hemiplegia is one of motor paralyses that do not allow paralytic muscle to generate a proper magnitude of force at a necessary moment. In order to treat a hemiplegia patient having the above symptom, various treatment methods, such as muscular strength training, motor control training, stretching, or balance training, may be used.

Meanwhile, as rehabilitation for an arm of a hemiplegia patient, a treatment for forcibly using the hemiplegic arm has been recognized as a successful treatment method.

As a result of performing body weight load training on stroke patients that may stand up by Nugent, et al., in 1994, it has been reported mat the more the repeated frequency, the better the walking becomes.

The present inventors proposed a slide board athletic apparatus, which is a rehabilitation treatment apparatus leading to the force use of legs, capable of removing a psychological feeling of uneasiness by allowing a patient to lie down on the board or by flexing and extending his knees at a prone position or a stable position by putting the feet on a foothold and allowing a patient to perform exercises by controlling an inclined angle of the board as rehabilitation treatment mentioned in Korean Patent Application No. 10-2004-0017633.

However, the slide board athletic apparatus for rehabilitation proposed by the present inventors includes a fixing frame and a foot bedplate that are integrally formed to support two legs of a patient on the foot bedplate. The slide board athletic apparatus has a problem in that a patient unconsciously puts weight on only a normal leg, which reduces a rehabilitative exercise effect when the hemiplegia patient takes an exercise applying weight to legs during the rehabilitation treatment.

In addition, in order to train normal walking that is performed by moving a body weight and changing an angle of joints of both legs every hour, muscle training for shifting a body weight and muscle training for changing an angle of a joint should be simultaneously performed. However, Korean Patent Application No. 10-2004-0017633 has a problem in that since it does not include a component for recognizing an angle of joints, it cannot confirm whether or not a patient uses the joints of hemiplegic legs, and thus, the rehabilitation for normal walking is inefficient.

Rehabilitative exercises for normal walking are performed by repeating the support of body weight while flexing a knee of one leg by about 15 degrees. The rehabilitation treatment for training the normal walking may be required to confirm that the body weight movement and the angle of joints are organically associated with each other and changed. However, there is a problem in that the related art does not have any method of confirming the change and performs only the rehabilitation treatment that repeats a motion, such as flexing and extending knees.

Further, although there is a need to take an aerobic exercise using legs such as walking, bicycling, for health, difficult exercises are not pleasurable, and as a result, it is difficult to continuously be motivated to exercise.

In order to solve the above-mentioned problems, an urgent need exists for a leg rehabilitation system having a game function capable of being conveniently mounted an apparatus of a training system on a patient providing data regarding a state of a patient measured by the apparatus to the patient in real time, and allowing a patent to perform the rehabilitation treatment process without feeling bored.

Further, a need exists for a leg rehabilitation training system having a game function capable of allowing a patient to perform exercises at a supine position while removing a feeling of uneasiness that he or she may fall and easily controlling the training intensity of a patient by controlling a height of a back plate contacting a back of a patient.

SUMMARY

The present invention has been made in an effort to provide a leg rehabilitation system having a game function capable of allowing a patient to perform weight bearing exercises and aerobic exercises while visually viewing graphics displayed on a display unit in real time by utilizing game data generated according to a motion of alternate movements of the patient's legs.

An exemplary embodiment of the present invention provides a leg rehabilitation system having a game function, the system including: a back plate on which a patient lies down; a pair of variable frames connected to a bottom surface of a back plate so as to control an inclination of the back plate; an inclination controller hinge-connecting the bottom surface of the back plate to one end of the variable frame so that the inclination of the back plate to the variable frame is controlled; a base frame connected to the bottom of the variable frame to be supported to the bottom surface; a plurality of variable link parts connecting the variable frame to the base frame and rotatably hinge-connected to each variable frame and the base frame; and a stepper part provided with each foothold part connected in pair that is extendedly formed at the bottom end of the back plate to allow the patient to alternately move the legs downward, wherein the foothold part includes a load sensor for sensing a load transferred to each foothold part according to the circular motion of the leg when the patient alternately moves the legs and movement speed of the foothold parts connected with each other; a strain sensor which directly connected crank so sense torque of each lower extremity, a controller generating game data displayable to the outside as graphics based on load data according to the load sensed by the load sensor and the speed data according to speed; and a display unit displaying graphics corresponding to the game data generated by the controller to the outside. The load sensor may include a digital scale.

The game data generated in the controller corresponding to the speed data according the speed of the foothold part may be configured to correspond to the advanced speed of graphic displayed on the display unit and the game data generated in the controller corresponding to the load data according to each load of the foothold part may be configured to correspond to the left and right directions of graphic displayed on the display unit.

The leg rehabilitation system having a game function may further include a pair of pulling parts moving upward and downward according to the movement of the thigh by penetrating the back plate through a predetermined portion of the back plate in order to measure the exercise amount of a thigh protruding upward while a patient's knee is bent by allowing a patient to alternately move in a circular motion the feet of the legs downward through the stepper part.

One end of the back plate opposite to the stepper part may be provided with a fixing bracket and: the fixing bracket may be the fixing bracket is connected to a safety belt of which length can be adjusted, the safety belt connecting to a fixing belt that is worn on the waist of the patient.

Each variable link part may be rotatably hinge-connected with the base frame and the variable frame in order to vary in inverse proportion to the distance between Y_axes according to the variation of the distance between X-axes, the top end of each variable link part may be hinge-connected to correspond to both sides of the variable frame back and forth, the central part thereof may be hinge-connected to a plurality of fixing ends protrudedly formed upward from the base frame to vary in inverse proportion to the distance between the X and Y-axes of the variable link part based on each fixing end as a rotating axis, and the bottom end of each variable link part may be connected by the support plate disposed on the bottom portion of the base frame, such that when the variable link part rotates by a predetermined angle or more based on the fixing end as the rotating axis, the top surface of the support plate may contact the bottom surface of the base frame so that the variable link part is fixedly configured to stop the rotation. Each stepper unit may be configured to include the foothold part having the patient seated on the top surface thereof, an elastic recovery part disposed on the bottom part of the foothold part to elastically support the foothold part when the foothold part performs a translational motion, a fastening unit surrounded upward from both sides of the foothold part for fixing a patient's foot seated on the top surface of the foothold part, and a first controller rotatably disposed on one side of the foothold part in order to control the magnitude of the elastic force applied from under the foothold part.

A support plate formed with a rotating part independently and rotatably connected with each foothold part may be provided between the respective foothold parts, a link part vertically connected by a support pin extendedly formed vertically downwardly of the foothold part may be provided, and the front end of the link part may be rotatably connected with the rotating part, and the back end thereof may be connected to the elastic recovery part to be elastically recovered by the elastic recovery part when the foothold part falls by the load of the patient.

The foothold part and the elastic recovery part may be provided with each load sensor and the load sensor of each foothold part may sense the stroke frequency that the foothold part moves downward and transfers the sensed stroke frequency to the controller and the load sensor included in the elastic recovery part may sense the load amount that the foothold part moves downward and transfers the sensed load amount to the controller.

Each pulling part may be configured to include a belt part surrounding a thigh of a patient, a joint part integrally connected to the bottom portion of the belt part, an arm part of which one end is connected to the bottom portion of the joint part to hold an elastic recovering force in connection with the movement of the joint part upward and downward, and a second controller rotatably disposed at one side of the joint part in order to control the magnitude in elastic force received from the bottom of the arm part. Further, each arm part may be provided with the load sensor and the load sensor senses the tension amount of the arm part moving upward and the angle of the knee joint and transfers the sensed tension amount and angle of the knee joint to the controller.

First, the leg rehabilitation system having a game function according to the exemplary embodiments of the present invention allows a patient to perform weight bearing exercise while arousing an interest when visually viewing graphics displayed on a display unit in real time by utilizing game data generated according to a motion of when a patient alternately moves his legs in a circular motion.

Second, the exemplary embodiments of the present invention can forcibly use the affected leg at the time of flexing and extending a knee joint using only the affected leg and relatively increase activity of involved lower extremity muscle and can simultaneously perform an eccentric motion, and a concentric motion of a leg with a paralyzed or weakened muscle in addition to me forcible use of the involved leg and can control the exercise load by controlling the inclination of the back plate to thereby quantify the motion.

Third, the exemplary embodiments of the present invention can include the stepper part and the first controller and the second controller of the pulling part to delicately control the exercise load in addition to the gradient of the back plate.

Fourth, although the help of a therapist is required at the time of training the legs for enduring the body weight load, the leg rehabilitation treatment apparatus according to the exemplary embodiments of the present invention can be conveniently operated by a remote controller or a controller and is designed to easily go up and down a patient on the table and may allow a patient to train so as to move like abnormal person by showing the patient's state in real time without separately including the muscle measurement mechanism and showing the data of a normal person together, such that a patient and a caregiver can easily train without helping from a therapist.

DETAILED DESCRIPTION

A context detection method and a context detection system according to exemplary embodiments of the present invention will be described below with reference to accompanying drawings.

Hereinafter, exemplary embodiments of the present invention will be described in detail with reference to the accompanying drawings.

Figure 1:
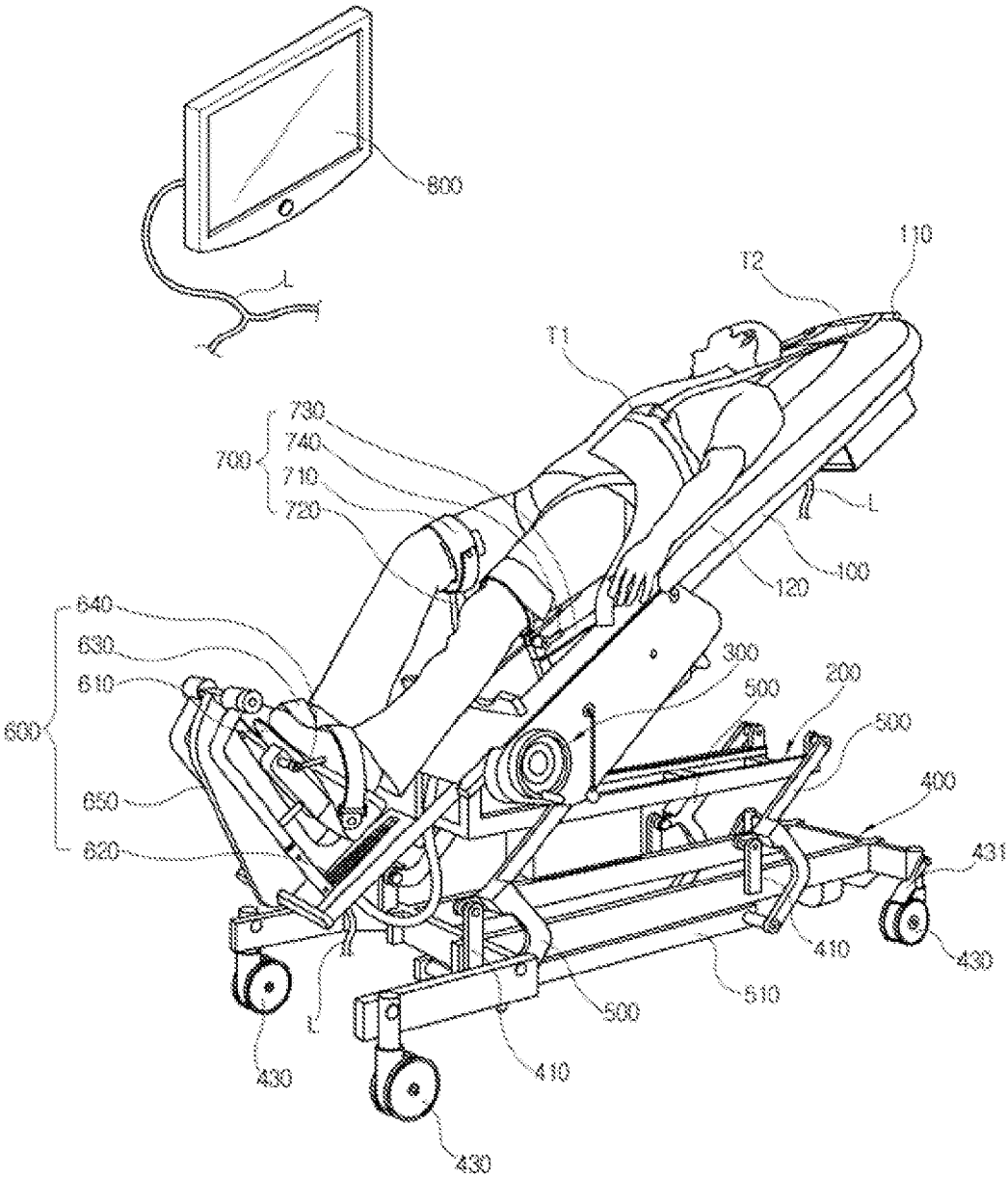
FIG. 1 is a perspective view schematically showing a leg rehabilitation system having a game function according to an exemplary embodiment of the present invention.
Figure 2:
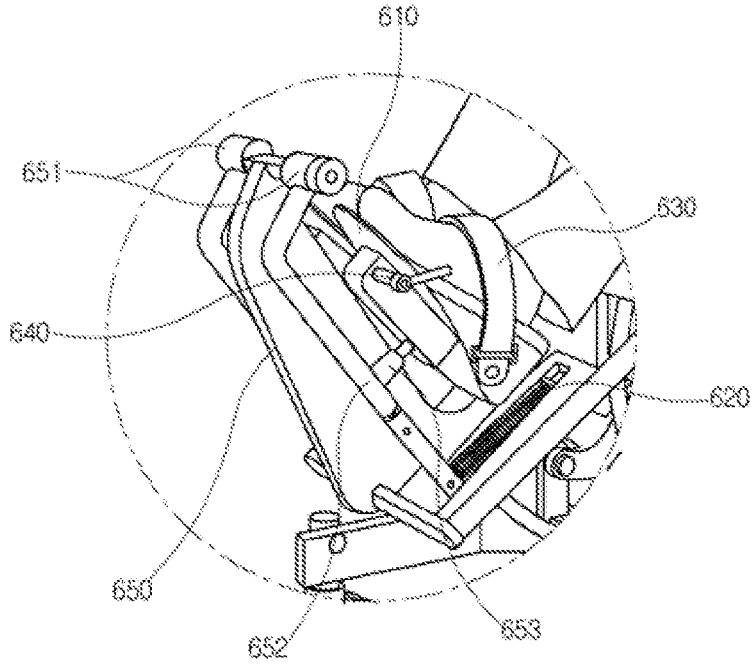
FIG. 2 is an enlarged diagram of main components showing a portion of FIG. 1.
Figure 3:
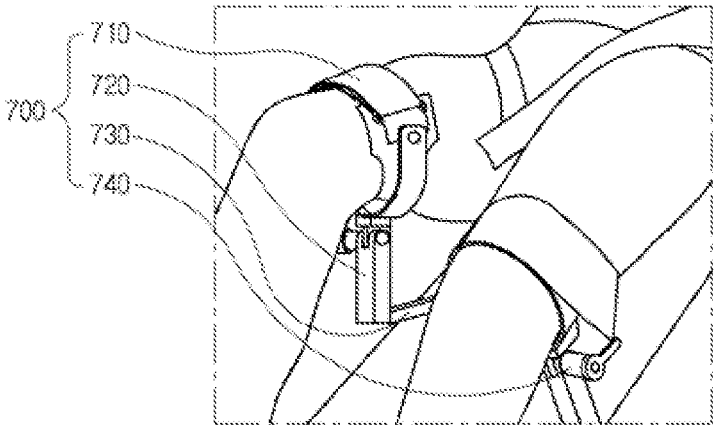
FIG. 3 is an enlarged diagram of main components showing a portion of FIG. 1.

FIG. 1 is a perspective view schematically showing a leg rehabilitation system having a game function according to an exemplary embodiment of the present invention, FIG. 2 is an enlarged diagram of main components showing a portion of FIG. 1, and FIG. 3 is an enlarged diagram of main components showing a portion of FIG. 1.

As shown in FIGS. 1 to 3, the leg rehabilitation system having a game function according to the exemplary embodiment of the present invention includes a back plate 100 on which a patient may lie down; a pair of variable frames 200 connected to a bottom surface of the back plate 100 so as to be capable of controlling the inclination of the back plate 100 to be elevated in a parallel state; an inclination controller 300 hinge-connecting one end of the variable frame 200 to the bottom surface of the back plate 100 so as to control the inclination of the back plate 100 with respect to the variable frame 200; a base plate 400 connected under the variable frame 200 to be supported to the bottom surface; a plurality of variable link parts 500 connecting the variable frame 200 with the base frame 400 to be rotatably hinge-connected to each variable frame 200 and the base frame 400; a stepper part 600 provided with each foothold part 610 connected in pair that is extendedly formed at the bottom end of the back plate 100 to allow the patient to alternately move the legs downward, wherein the foothold part 610 includes a load sensor 615 sensing a load transferred to each foothold 610 according to the circular motion of the leg when the patient alternately moves the legs and movement speed of the foothold parts 610 connected with each other; a controller 900 generating game data displayable to the outside as graphics based on load data according to the load sensed by the load sensor 615 and the speed data according to speed; and a display unit 800 displaying graphics corresponding to the game data generated by the controller 900 to the outside. The pair of footholds 610 formed on the stepper part 600 are disposed corresponding to both legs of the patient, and preferably, each foothold part 610 integrally moves, the driving shaft of each foothold part 610 may have a structure where it is configured as a rotation torque and each foothold part 610 is rotated to be connected with each other or it is configured to be operated by an oil pressure and each foothold part 610 is linearly moved to be connected with each other. In an additional exemplary embodiment, the speed data may be measured even by a sensor (not shown) connected to a crank shaft connected for the rotational movement of the foothold part, separately from the load sensor 615 included on the foothold part 610 or instead of the load sensor 615. In one embodiment, the rotational speed of the foothold parts 610 can be measured by a separate rotational speed sensor 635, such as a shaft encoder, a tachometer, etc.

The game data generated in the controller 900 corresponding to the speed data according to the speed of the foothold part 610 are configured to correspond to the a advanced speed of graphics displayed in the display unit 800 and the game data generated in the controller 900 corresponding to the load data according to each load of the foothold part 610 are configured to correspond to the left and right directions of graphics displayed on the display unit 800.

In order to measure the exercise amount of a thigh protruding upward while a patient's knee is bent by allowing a patient to alternately move in a circular motion a foot of a leg downward through the stepper 600, it further includes a pair of pulling parts 700 vertically moving according to the motion of the thigh by penetrating the back plate 100 through a predetermined portion of the back plate 100.

A reference numeral L of FIG. 1 represents a lead wire that connects load sensor 715 and 735 disposed on each pulling part 700, load sensor 615 and 625 disposed on each stepper part 600, and the controller 900 disposed on the display unit 800.

The controller 900 may be configured to be included in the display unit 800. Alternatively, the controller 900 may be positioned at a rear surface of the back plate 100. Accordingly, the controller 900 includes an MPU or a CPU, or the like, that are connected to each load sensor 615, 625, 715, and 735 (S) through a wireless or wired manner and generates "measurement value data" regarding each load data according to the load of each foothold part 610 of the stepper part 600, the speed data according to the rotation stroke of the pair of foothold parts 610 integrally moving to be connected with each other, the tension amount of a thigh measured by the pulling part 700, and the angle of the knee joint, and can calculate "comparative data" generated by comparing previously input "reference value data" with each "measurement value data".

The patient may recognize his/her state changed according to the training though the display unit 800 displaying the game data transferred in real time to the outside by the controller 900.

The controller 900 generates the game data using the load data and the speed data due to the foothold part 600 as variables and transfers the game data to the display unit 800. As a result, the game may be performed through the display unit 800. Since a patient may feel bored by the rehabilitation treatment with the repeatedly same posture, the rehabilitation treatment may be performed through the game achieving a target of motivating more interest.

Figure 4:
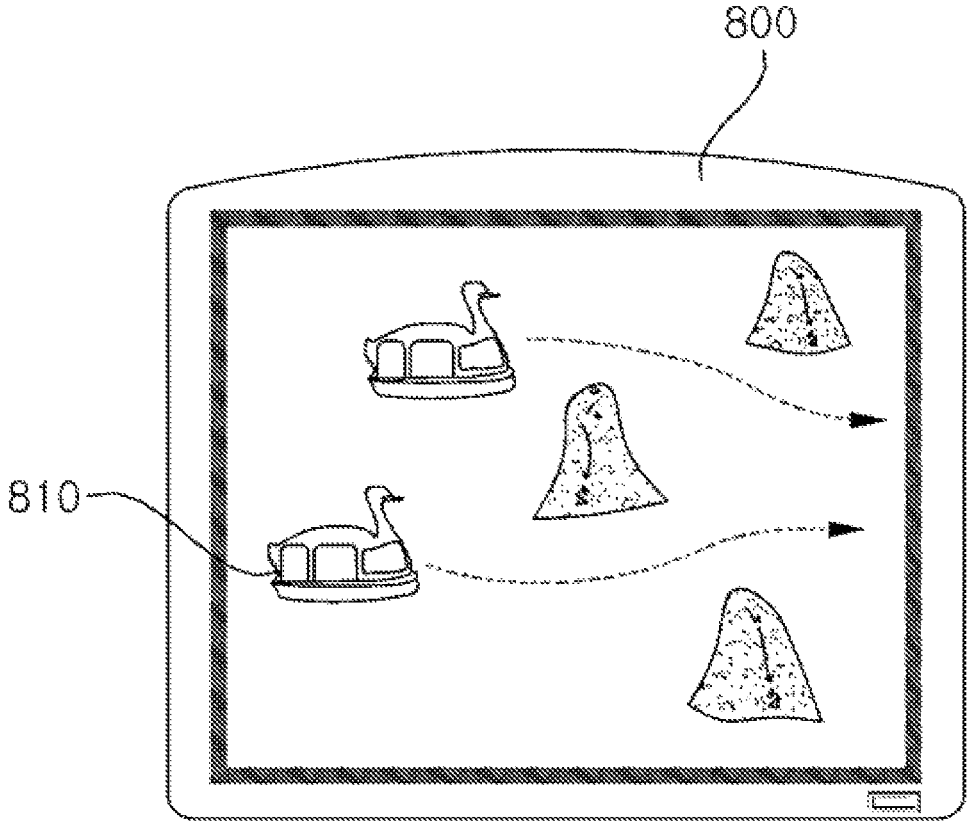
FIG. 4 is a diagram showing one exemplary embodiment of graphics displayed on a display unit in the leg rehabilitation system having a game function according to the exemplary embodiment of the present invention.

Referring to FIG. 4, the game data generated in the controller 900 corresponding to the speed data according to the speed of the foothold part 610 is configured to correspond to the advanced speed of the graphics 810 displayed on the display unit 800 and the game data generated in the controller 900 corresponding to the load data according to each load of the foothold part 610 is configured to correspond to the left and right directions of the graphic 810 displayed on the display unit 800. A bicycle race, a motor race, a run race, etc., may be implemented in the display unit 800 by the above-mentioned game data. FIG. 4 shows a duck-shaped pedal boat race game including obstacles as an exemplary embodiment. In order to take a three-dimensional simulation game shape connected with the game, the back plate capable of supporting the back portion of the patient or the stepper part formed with two foothold parts connected in pair in order to allow a patient to alternately move his or her leg in a circular motion downward may have a similar configuration to a pedal boat or a bicycle. However, the back plate and the stepper part may have various shapes. In this configuration, the three-dimensional simulation game means that the real situation is implemented by a video game or a computer game. In particular, in the case of a motor race, the video game or the computer game may be implemented using a three-dimensional structure implementing a real situation so that a gamer plays a race game in a structure similar to the real car. The configuration provides a similar experience like participating in a real race to a rehabilitation patient who cannot freely move by implementing the pedal boat race, such that the rehabilitation patient may enjoy the rehabilitation exercises. Another exemplary embodiment may be applied to the three-dimensional virtual reality game. That is, the back plate and the stepper part are configured as a hang glider and the rehabilitation patient may change the traveling direction of the virtual hang glider displayed on the display unit using the pedal of the stepper part. The present invention may be applied to the virtual reality game in which the background screen viewed to the rehabilitation patient is also changed according to the change of the traveling direction of the virtual hang glider. As the detailed exemplary embodiment, when the pedal of the stepper part quickly spins, it quickly goes forward, when the pedal in right side rotate with more power than that of left, a screen goes right, and when the pedal in left side rotate with more power than that of right, a screen goes left, such that the background screen, i.e., Grand Canyon may be displayed according to the motion of an operating person. The configuration provides a similar experience to a real situation to a rehabilitation patient who cannot freely move through the virtual reality game, such that the rehabilitation patient may enjoy the rehabilitation exercises more.

Describing a bicycle as one example, when a larger force is applied to the left foothold part 610, i.e., the load data of the left foothold part 610 is larger, the bicycle on the graphic displayed on the display unit 800 changes the direction to the left and to the contrary, when a larger force is applied the right foothold part 610, i.e., the load data of the right foothold part 610 is larger, the bicycle on the graphic displayed on the display unit 800 is configured to change the direction to the left.

Since the foothold part 610 of the stepper part 600 is configured to integrally stroke or rotate each foothold part 610, when the patient quickly stamps the foothold part 610, i.e., the speed data according to the speed of the foothold part 610 is large, the bicycle on the graphic displayed on the display unit 800 is configured to quickly advance and to the contrary, when the speed data according to the speed of the foothold part 610 is small, the bicycle on the graphic displayed on the display unit 800 is configured to slowly advance.

The game data generated by the controller 900 is transferred to the display unit 800 and is viewed to the patient. The display unit 800 may be any one of a monitor, an electric sign, an LED window, and a rehabilitation system only monitor. The contents displayed on the display unit may include basic information of a patient including a name, an age, height, weight, etc., of a patient, information on reference value data selectively used, a real-time graph generated in real time by the measurement value data and the reference value data, data numerically representing a current exercise state of a patient, etc. The game data output by the display unit 800 may be a graph, characters, or numbers that are changed in real time. However, it is apparent that this may be only one example of the display unit and any contents capable of easily recognizing the patient's state may be displayed on the display unit.

The load transferred to the foothold parts 610 and the exercise speed of the foothold parts 610 connected with each other are measured in real time and are displayed through the display unit 800 and the patient recognizes the information on the display unit 80 to know his/her exercise state. In addition, the proper exercise range according to the reference value data of the patient is displayed on the display unit 800. such that the patient confirms whether his/her exercise state is within the proper exercise range, thereby inducing the preferable exercise state of the patient. Further, the preferable exercise state of the patient may be positively induced by assisting the movement of the foothold part 610 by a power device such as a motor.

Figure 5:
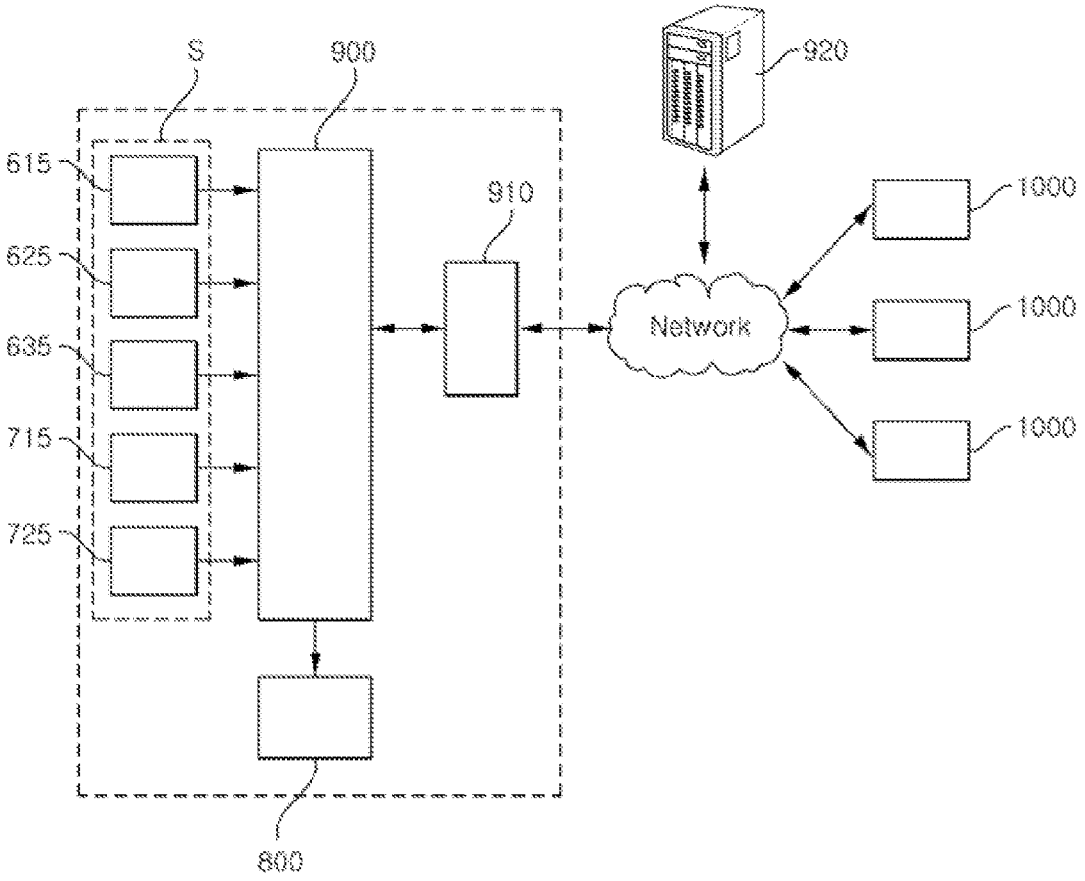
FIG. 5 is a diagram showing a structure in which the leg rehabilitation system having a game function according to the exemplary embodiment of the present invention in order to allow a patient and other users to perform a game is connected to a terminal having other game functions.

Meanwhile, in order to prevent the patient from excessively taking an exercise, it may be set to suppress or discourage the exercise of the patient once the patient exceeds a predetermined range of exercise intensity. In one embodiment, as a method for determining the excessive exercise state of the patient, when the rotational speed of the foothold part 610 or the heart rate of the patient exceeds a predetermined value or the heart rate of the patient exceeds a predetermined value, it may be determined that the patient is in the excessive exercise state. As the method for suppressing or discouraging the excessive exercise of the patient, a visual warning through the display unit 800 or an audible warning with sound may be alarmed to the patient. In addition, in spite of the warnings, when the excessive exercise state of the patient is continued for a predetermined time, it is possible to positively induce the preferable exercise state of the patient by automatically stopping the game or assigning a penalty to the patient in the game. Referring to FIG. 5, the patient may perform alone the game function implemented by the leg rehabilitation system according to the exemplary embodiment of the present invention and perform the game function simultaneously with multiple users in one game space through a network. To this end, the leg rehabilitation system including a game function according to the exemplary embodiment of the present invention may include a communication interface 910. The communication interface 910 accesses the leg rehabilitation system according to the exemplary embodiment of the present invention to a server 920 or a terminal 1000 of another user through the network to perform data communication. The patient uses the communication interface 910 to perform a game through the network, together with multiple users. The network may be, for example, an internal network or Internet, etc. The terminal 1000 of another user accessing the network may be an apparatus having the same configuration as the leg rehabilitation system according to the exemplary embodiment of the present invention. However, if the terminal 1000 of another user is an apparatus that can perform the same game as the game implemented by the leg rehabilitation system according to the exemplary embodiment of the present invention by accessing the server 920 by compatible protocol or directly accessing the leg rehabilitation system of the patient, it need not have the same configuration as the leg rehabilitation system according to the exemplary embodiment of the present invention and for example, may be a game only terminal.

Figure 6:
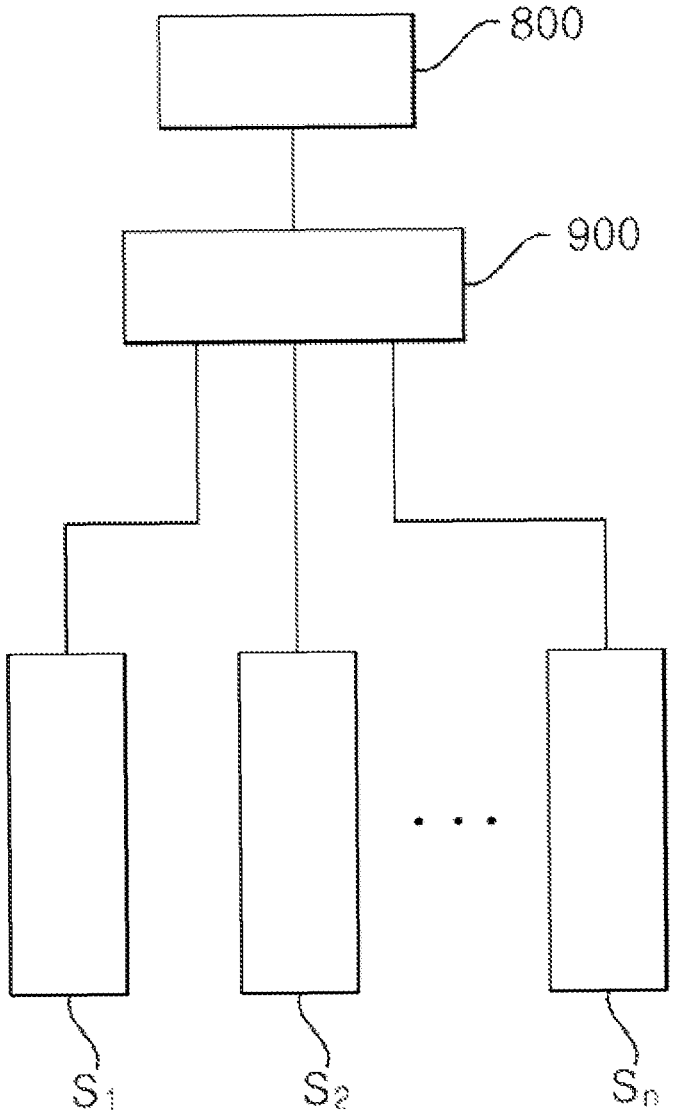
FIG. 6 is a diagram showing a structure in which the leg rehabilitation system having a game function according to the exemplary embodiment of the present invention in order to allow a patient and other users to perform a game is connected to another leg rehabilitation system.

In addition, referring to FIG. 6, multiple patients use the leg rehabilitation system according to the exemplary embodiment of the present invention without passing through a separate server or network to perform the rehabilitation while performing the game in the same game space. The leg rehabilitation systems of each patient each include at least one leg rehabilitation units S1, . . . , Sn, wherein each leg rehabilitation unit S1, . . . , Sn may have the configuration shown in FIGS. 1 to 3 and may include the back plate 100 capable of supporting at least the back of a patient, the stepper part 600 provided with each foothold part 610 extendedly formed to the bottom end of the back plate 100 and connected in pair to allow the patient to alternately move the legs downward, and the load sensor 615 provided on the foothold plate 610 and sensing the load transferred to each foothold part 610 and the movement speed of the foothold part when the patient alternately moves the legs, and is connected to the controller 900. In FIGS. 5 and 6, the back plate capable of supporting the back portion of the patient or the stepper part provided with two foothold parts connected in pair to allow the patient to alternately move downward the legs may be omitted for convenience. However, the structure of the leg rehabilitation units S1, . . . , Sn is not limited to the exemplary embodiment shown in FIGS. 1 to 3 and may have various shapes, including a structure including the back plate capable of supporting the back portion of the patient and the stepper part provided with two foothold parts connected in pair to allow the patient to alternately extend lower extremity. The controller 900 generates the game data corresponding to each patient based on the signal transferred from the plurality of leg rehabilitation units S, S, . . . , Sn. The game data for each patient generated by the controller 900 is displayed as a graphic by the display unit 800. In the exemplary embodiment, one controller 900 is configured to process the signal transferred from the plurality of leg rehabilitation units S, S, . . . , Sn, but the controller 900 may be provided in plural to separately process the signals of each rehabilitation unit S, S, . . . , Sn.

The inclination controller 300 may be configured as an oil pressure cylinder and is supported by a base frame 400 and a variable frame 200 and is connected with a variable link part 500 to control the height and the inclination of the back plate 100.

The variable link part 500 which is connected between me base frame 400 and the variable frame 200 to rotate by a predetermined angle may be configured to rotate by oil pressure. In this case, the link connection portion of the inclination controller 300 and the variable link part 500 may be controlled through a remote controller (not shown), thereby making it possible to promote the convenience of a patient. In addition, the state of the patient is measured by the remote controller and the controller 900 and the measured results are transferred to the display unit 800.

The base frame 400 may be configured as a rectangular shape and four corners of the base frame 400 is provided with a wheel part 430 rotating to be supported outwardly to the bottom surface, wherein each wheel part 430 is provided with a stop part 431 fixing the rotation of the wheel.

As shown in FIG. 1, one end of the back plate 100 opposite to the stepper part 600 is provided with a fixing bracket 110 and the fixing bracket 110 is connected to a safety belt T2 of which length can be adjusted, wherein the safety belt T2 is connected to a fixing belt T1 that is worn on the waist of the patient.

When the inclined angle of the back plate 100 with respect to the variable frame 200 becomes large due to the operation of the inclination controller 300 by including one end of the safety belt T2 fixed to the fixing bracket 110, the patient that lies down on the back plate 100 is sled from the back plate 100 to prevent the patient from separating.

As shown in FIG. 1, each variable link part 500 is rotatably hinge-connected with the base frame 400 and the variable frame 200 to vary in inverse proportion to the distance between Y_axes according to. the variation of the distance between X-axes. The top end of each variable link part 500 is hinge-connected to corresponding four corners of the variable frame 200, the central part of each variable link part 500 is hinge-connected to the corresponding fixing ends 410 protrudedly formed upward from the base frame 400, such that the distance between the X and Y-axes of the variable link part 500 varies in inverse proportion based on each fixing end 410 as a rotating axis, and when the bottom end of each variable link part 500 is connected to the support plate 510 disposed on the bottom portion of the base frame 400. When the variable link part 500 is rotated by a predetermined angle or more based on the fixing end 410 as the rotating axis, the top surface of the support plate contacts with the bottom surface of the base frame 400 so as to stop the rotation of the variable link part 500.

As shown in FIG. 2, each stepper unit 600 is configured to include a foothold part 610 having the patient's foot seated on the top surface thereof, an elastic recovery part 620 disposed on the bottom part of the foothold part 610 to elastically support the foothold part 610 when the foothold part 610 performs a translational motion, a fastening unit 630 surrounded upward from both sides of the foothold part 610 for fixing a foot of a patient seated on the top surface of the foothold part 610, and a first controller 640 rotatably disposed on one side of the foothold part 610 in order to control the magnitude of the elastic force applied from under the foothold part 610.

The first controller 640 is provided at one side of the foothold part 610, and preferably, is operated by oil pressure and the magnitude in torque for the rotation force of the rotating part 651 with respect to a predetermined load applied from the top surface of the foothold part 610 may be controlled by controlling the oil pressure by the first controller 640 and the magnitude in elastic force and the recovering force applied to the elastic recovery part 620 may be also changed accordingly.

As shown in FIG. 2, a support plate 650 formed with a rotating part 651 independently and rotatably connected with each foothold part 610 is provided between the respective foothold parts 610, a link part 652 vertically connected by a support pin 653 extendedly formed vertically downwardly of the foothold part 610 is provided, and the front end of the link part 652 is rotatably connected with the rotating part 651, and the back end thereof is configured to be connected to the elastic recovery part 620 to be elastically recovered by the elastic recovery part 620 when the foothold part 610 falls by the load of the patient.

Each foothold part 610 disposed left and right by the support plate 650 alternately moves upward and downward, the front end of the support plate 650 is provided with the left/right rotating parts 651 fitted in the rotatable shaft, the outer circumferential surface of each rotating part 651 is rotatably connected to the front end of the link part 652 connected to the bottom portions of each foothold part 610, and the back end of the link part 652 may be fastened with the bottom end of the elastic recovery part 620 configured of a pulling spring, so that the elastic recovery part 620 is expanded upward and downward to have an elastic recovering force when each foothold part 610 moves downward.

The foothold part 610 and the elastic recovery part 620 are provided with each load sensor and the load sensor 615 of each foothold part 610 senses the stroke frequency that the foothold part 610 moves downward and transfers the sensed stroke frequency to the controller 900, and the load sensor 625 included in the elastic recovery part 620 senses the load amount that the foothold part 610 moves downward and transfers the sensed load amount to the controller 900.

Describing in more detail, the load sensor 615 and 625 may include the pressure sensor or the elastic mechanism, etc. An example configuring the pressure sensor may include a force plate. For example, an example configuring the pressure sensor may include a scale measuring the magnitude of the load according to the degree in which the state of the elastic mechanism is changed by indirectly contacting the elastic mechanism to the sole of the foot. However, the above description is only an example and in the leg rehabilitation system having the game function suggested in the present invention, it is apparent that other methods capable of measuring the magnitude of the load applied to the sole of the foot may be applied to the present invention.

As shown in FIG. 3, each pulling part 700 is configured to include a belt part 710 surrounding a thigh of a patient, a joint part 720 integrally connected to the bottom portion of the belt part 710, an arm part 730 of which one end is connected to the bottom portion of the joint part 720 to hold an elastic recovering force in connection with the movement of the joint part 720 upward and downward, and a second controller 740 rotatably disposed at one side of the joint part 720 in order to control the magnitude in elastic force received from the bottom of the arm part 730.

In the process of alternately repeating the flexing and extending of the knee joint of the patient in connection with the motion of each foothold part 610 upward and downward by allowing the patient to alternatively move in a circular motion the feet, each pulling part 700 also moves upward and downward accordingly.

The second controller 740 is provided at one side of the joint part 720 and preferably, is operated by the oil pressure like the first controller 640 and the magnitude of the elastic recovering force of the arm part 730 moving to be connected to the thigh of the patient may be controlled in the process of moving the thigh upward while the knee joint of the patient is flexed by controlling the oil pressure by the second controller 740.

Each arm part 730 is provided-with the load sensor 735 and the load sensor 735 senses the tension amount of the arm part 730 moving upward and the angle of the knee joint and transfers the sensed tension amount and angle of the knee joint to the controller 900. The load sensor 735 has the same function as described in the above foothold part 610.

As shown in FIG. 1, a cushion pad 120 is configured to be attached to the top surface of the back plate 100 for performing the buffering action while supporting the back of the patient that lies down on the back plate 100.

As described above, the leg rehabilitation system having a game function according to the exemplary embodiments of the present invention can be variously changed and modified within the technical idea of the present invention by a person in the skilled in the art to which the present invention pertains and an equivalent scope of claim described below.

What is claimed is:

1. A leg rehabilitation system having a game function, the system comprising:

a back plate for supporting a patient;

a pair of variable frames connected to a bottom surface of the back plate wherein the pair of variable frames are configured to be elevated horizontally and the back plate is configured to be inclinable at an angle with respect to the variable frames;

an inclination controller for hinge-connecting the bottom surface of the back plate to one end of the variable frame wherein the inclination controller controls inclination of the back plate with respect to the variable frame;

a base frame connected to the bottom surface of the variable frame to be supported above the ground surface;

a plurality of variable link parts for connecting the variable frame to the base frame and rotatably hinge-connected to each of the variable frames and the base frame;

a stepper part having two foothold parts connected in pair, the stepper part being extended from the bottom portion of the back plate in such a manner that a patient can move the two foothold parts downwardly in turn with legs of the patient, wherein at least one of the foothold parts includes a load sensor for sensing a load transferred to each foothold part according to circular motion of the legs when the patient alternately moves the legs and movement speed of the foothold parts connected with each other;

a controller configured for generating game data based on load data according to the load sensed by the load sensor and the speed data according to the movement speed; and a display unit for displaying game elements corresponding to the game data generated by the controller wherein the game elements includes graphical game elements.

2. The system of claim 1, wherein the game data generated in the controller corresponding to the speed data according the movement speed of the foothold part and game data generated corresponding to the load data according to each load of the foothold part are configured to control directional movement of one of the game elements displayed on the display unit.

3. The system of claim 2, further comprising a pair of pulling parts moving upward and downward according to the movement of the thigh by penetrating the back plate through a predetermined portion of the back plate in order to measure the exercise amount of a thigh protruding upward while a patient's knee is bent by allowing a patient to alternately move in a circular motion the feet of the legs downward through the stepper part.

4. The system of claim 3, further comprising a fixing bracket formed at one end of the back plate opposite to the stepper part wherein the fixing bracket is coupled with a safety belt of which length can be adjusted, the safety belt connecting to a fixing belt that is worn on the waist of the patient.

5. The system of claim 3, wherein each variable link part is rotatably hinge-connected with the base frame and the variable frame in such a manner that the distance between Y_axes varies in inverse proportion to the variation of the distance between X-axes, the top end of each variable link part is hinge-connected to correspond to both sides of the variable frame back and forth, and the central part thereof is hinge-connected to a plurality of fixing ends protrudedly formed upward from the base frame to vary in inverse proportion to the distance between the X and Y-axes of the variable link part based on each fixing end as a rotating axis, and when the bottom end of each variable link part is connected by the support plate disposed on the bottom portion of the base frame to rotate the variable link part by a predetermined angle or more based on the fixing end as me rotating axis, the top surface of the support plate contacts the bottom surface of the base frame, so that the variable link part is fixedly configured to stop the rotation.

6. The system of claim 2, wherein each stepper unit comprises:

the foothold part having an upper surface on which the patient's foot is seated;

an elastic recovery part disposed on a bottom part of the foothold part to elastically support the foothold part when the foothold part performs a translational motion;

a fastening unit for holding a foot of the patient, which is seated on the top surface of the foothold part; and a first controller rotatably disposed on one side of the foothold part in order to control a magnitude of the elastic force applied from the bottom of the foothold part.

7. The system of claim 6, further comprising:

a support plate formed with a rotating part independently and rotatably coupled with each foothold part wherein the support plate is positioned between the respective foothold parts; and a link part connected by a support pin wherein a first end of the link part is rotatably connected with the rotating part, and a second end of the link part is connected to the elastic recovery part to be elastically recovered by the elastic recovery part when the foothold part is moving downwardly with the load of the patient.

8. The system of claim 7, wherein both the foothold part and the elastic recovery part include respective load sensor and the load sensor e of each foothold part senses stroke frequency that the foothold part moves downward and transfers the sensed stroke frequency to the controller.

9. The system of claim 3, wherein each pulling part comprises a belt part surrounding a thigh of a patient, a joint part integrally connected to the bottom portion of the belt part, an arm part of which one end is connected to the bottom portion of the joint part to hold an elastic recovering force in connection with the movement of the joint part upward and downward, and a second controller rotatably disposed at one side of the joint part in order to control the magnitude in elastic force received from the bottom of the arm part.

10. The system of claim 9, wherein each arm part comprises the load sensor and the load sensor senses the load amount of the arm part moving upward and the angle of the knee joint and transfers the sensed tension amount and angle of the knee joint to the controller.

11. The system of claim 2, further comprising a cushion pad attached to the top surface of the back plate for performing buffering action while supporting the back of the patient that lies down on the back plate.

12. A leg rehabilitation system having a game function, the system comprising:

a back plate for supporting a back of a patient;

a stepper part having two foothold parts, the back plate being extended from a bottom portion of the back plate in such a manner that a patient can move the two foothold parts downwardly in turn with legs of the patient, a load sensor positioned on the stepper part for sensing a load transferred to each foothold part and the movement speed of the foothold part when the patient moves the legs; a controller configured for generating game data based on load data according to the load sensed by the load sensor and speed data according to the movement speed; and a display unit for displaying graphical game elements corresponding to the game data generated by the controller.

13. The system of claim 12, further comprising a communication interface sharing the game data generated by the controller with a terminal of at least one of other users through the network to allow a patient to perform the game together with other users.

14. The system of claim 13, wherein, it is directly connected to the terminal of other users.

15. The system of claim 13, wherein it is connected to the terminal of other users through a server.

16. The system of claim 12, wherein the display unit displays the exercise state of the patient.

17. The system of claim 12, wherein if it is determined that the patient takes an exercise at intensity exceeding the predetermined exercise range, warnings are output to the patient.

18. The system of claim 12, wherein when the state in which the patient takes an exercise at intensity exceeding the predetermined exercise range continues for a predetermined time or more, the game performed by the patient stops.

19. A leg rehabilitation system having a game function, the system comprising:

a first leg rehabilitation unit including a back plate for supporting a back of a patient; a stepper part having two foothold parts, the back plate being extended from a bottom portion of the back plate in such a manner that a patient can move the two foothold parts downwardly in turn with legs of the patient; and a load sensor positioned on the stepper part for sensing a load transferred to each foothold part and the movement speed of the foothold part when the patient moves the legs;

a second leg rehabilitation unit including a back plate for supporting a back of a patient; a stepper part having two foothold parts, the back plate being extended from a bottom portion of the back plate in such a manner that a patient can move the two foothold parts downwardly in turn with legs of the patient; and a load sensor positioned on the stepper part for sensing a load transferred to each foothold part and the movement speed of the foothold part when the patient moves the legs;

at least one controller configured for generating game data based on load data according to the load and speed data according to the speed sensed by each load sensor included in the first and second leg rehabilitation units; and a display unit for displaying graphical game elements corresponding to the game data generated by the controller.

20. The system of claim 19, wherein the display unit displays the exercise state of the patient.

21. The system of claim 19, wherein the display unit displays the predetermined exercise range of the patient.

22. The system of claim 19, wherein if it is determined that the patient takes an exercise at intensity exceeding the predetermined exercise range, warnings are output to the patient.

23. The system of claim 22, wherein when the state in which the patient takes an exercise at intensity exceeding the predetermined exercise range continues for a predetermined time or more, the game performed by the patient stops.

24. A leg rehabilitation system having a game function, the system comprising:

a back plate for supporting a patient;

a pair of variable frames connected to a bottom surface of the back plate wherein the pair of variable frames are configured to be elevated horizontally and the back plate is configured to be inclinable at an angle with respect to the variable frames;

an inclination controller for hinge-connecting the bottom surface of the back plate to one end of the variable frame wherein the inclination controller controls inclination of the back plate with respect to the variable frame;

a base frame connected to the bottom surface of the variable frame to be supported above the ground surface;

a plurality of variable link parts for connecting the variable frame to the base frame and rotatably hinge-connected to each of the variable frames and the base frame;

a stepper part having two foothold parts connected in pair, the stepper part being extended from the bottom portion of the back plate in such a manner that a patient can move the two foothold parts downwardly in turn with legs of the patient;

two crank shafts for rotational movement of the foothold parts wherein each of the crank shafts is connected to the respective foothold parts;

a strain sensor coupled with the crank shafts so as to measure torque applied to the crank shafts according to circular motion of the legs;

a controller configured for generating game data based on load data according to the torque measured by the strain sensor; and a display unit for displaying game elements corresponding to the game data generated by the controller wherein the game elements includes graphical game elements.

25. The system of claim 24, further comprising a rotational speed sensor to measure rotational speed of the crank shafts, wherein the controller generates game data based on load data according to the torque measured by the strain sensor and the speed data according to the rotational speed.

* * * * *